US008960439B2

(12) United States Patent
Bando et al.

(10) Patent No.: US 8,960,439 B2
(45) Date of Patent: Feb. 24, 2015

(54) WET TISSUE PACKAGE AND PRODUCTION METHOD FOR SAME

(75) Inventors: Takeshi Bando, Kagawa (JP); Takahiro Ueda, Kagawa (JP); Ikue Hiramatsu, Kagawa (JP)

(73) Assignee: Uni-Charm Corporation, Ehime (JP)

( * ) Notice: Subject to any disclaimer, the term of this patent is extended or adjusted under 35 U.S.C. 154(b) by 219 days.

(21) Appl. No.: 13/579,510

(22) PCT Filed: Feb. 4, 2011

(86) PCT No.: PCT/JP2011/052324

§ 371 (c)(1), (2), (4) Date: Aug. 16, 2012

(87) PCT Pub. No.: WO2011/102234

PCT Pub. Date: Aug. 25, 2011

(65) Prior Publication Data

US 2012/0312713 A1 Dec. 13, 2012

(30) Foreign Application Priority Data

Feb. 19, 2010 (JP) ..... 2010-035444

(51) Int. Cl.

| | |
|---|---|
| ***B65D 85/00*** | (2006.01) |
| ***B65D 83/08*** | (2006.01) |
| ***B65D 75/58*** | (2006.01) |
| *A47K 10/32* | (2006.01) |

(52) U.S. Cl.

CPC ..... *B65D 83/0805* (2013.01); *B65D 75/5838* (2013.01); *B65D 83/0888* (2013.01); *A47K 2010/3266* (2013.01)

USPC ..... 206/525; 206/489

(58) Field of Classification Search

CPC ..... B65D 83/08; B65D 83/0888

USPC ..... 206/525, 489; 211/102

See application file for complete search history.

(56) References Cited

U.S. PATENT DOCUMENTS

| | | | | |
|---|---|---|---|---|
| 3,124,298 | A * | 3/1964 | Repko | 383/207 |
| 3,595,468 | A * | 7/1971 | Repko | 206/0.84 |

(Continued)

FOREIGN PATENT DOCUMENTS

| | | |
|---|---|---|
| JP | 3079883 U | 6/2001 |
| JP | 2002-302172 | 10/2002 |

(Continued)

OTHER PUBLICATIONS

International Search Report based on corresponding PCT application No. PCT/JP052324 dated Apr. 26, 2011 (2 pgs).

*Primary Examiner* — Steven A. Reynolds
*Assistant Examiner* — King M Chu
(74) *Attorney, Agent, or Firm* — Brinks Gilson & Lione

(57) ABSTRACT

A wet tissue package that is easily to manufacture with a used wet tissue storage receptacle disposed on a package body. Configured is a wet tissue package equipped with a package body and a used wet tissue storage receptacle, wherein the package body is equipped with a first seal portion formed by joining a pair of first side edges of a sheet member, and a pair of second seal portions formed by joining a pair of second side edges, and a wet tissue housing. The used wet tissue storage receptacle is composed of a first seal extension portion formed by extending in a direction that intersects a direction that the first side edges extend from the first seal, and a sheet member that composes the package body.

5 Claims, 18 Drawing Sheets

(56) References Cited

U.S. PATENT DOCUMENTS

| | | | | | |
|---|---|---|---|---|---|
| 4,252,238 | A | * | 2/1981 | Spiegelberg et al. | 383/210.1 |
| 4,428,477 | A | * | 1/1984 | Cristofolo | 206/210 |
| 4,570,820 | A | * | 2/1986 | Murphy | 221/34 |
| 4,616,470 | A | * | 10/1986 | Nakamura | 53/412 |
| 5,885,673 | A | * | 3/1999 | Light et al. | 428/35.4 |
| 2012/0312713 | A1 | * | 12/2012 | Bando et al. | 206/525 |
| 2014/0075892 | A1 | * | 3/2014 | Bando | 53/461 |

FOREIGN PATENT DOCUMENTS

| | | |
|---|---|---|
| JP | 2004-196303 | 7/2004 |
| JP | 3112574 U | 7/2005 |

* cited by examiner

WET TISSUE PACKAGE AND PRODUCTION METHOD FOR SAME

RELATED APPLICATION

This application is a 35 U.S.C. §371 national phase filing of International Patent Application No. PCT/JP2011/052324, filed Feb. 4, 2011, through which and to which priority is claimed under 35 U.S.C. §119 to Japanese Patent Application No. 2010-035444, filed Feb. 19, 2010.

TECHNICAL FIELD

The present invention relates to wet tissue packages and production methods therefor. More specifically, the present invention relates to a wet tissue package equipped with a package body, and a used wet tissue storage receptacle disposed at an outer surface of the package body.

BACKGROUND ART

Conventionally, pocket-type tissue packages that store in the package a plurality of compactly folded tissue paper, and wet tissue packages that store a plurality of wet tissues instead of tissue paper, are known. Such pocket-type tissue packages and wet tissue packages are carried by the user, such as when going out, for use.

However, when the pocket-type tissue package or wet tissue package is used while the user is outdoors where there is no waste box or the like available in the vicinity to discard a used tissue paper or wet tissue, the user is troubled by where to discard the used tissue or wet tissue.

For that reason, a package was proposed that was equipped with a used tissue storage receptacle that stores used tissue paper. (For example, see Patent Document 1.)

The package proposed in Patent Document 1 was equipped with a package body that stores tissue paper and a pocket disposed on the package. This package composes the package body by overlapping one end side in a width direction of the sheet material and another end side enclosing wet tissues using a belt-shaped sheet material, and by joining each opening formed at both ends in the longitudinal direction of the sheet material with the one end side and the other end side in an overlapped state. Also, the sheet material positioned at the outer side, of the sheet material in the overlapped state, is folded back to the outer side; both ends of the folded back sheet material in the longitudinal direction are joined to the package body thereby forming the used wet tissue storage receptacle.

[Patent Document 1] Application for Utility Model Registration No. 3079883

DISCLOSURE OF THE INVENTION

Problems to be Solved by the Invention

With the package proposed in Patent Document 1, the package body is formed by joining both ends of the sheet material in the longitudinal direction, with one end side and another end side in an overlapped state. One end side and another end side in the sheet material width direction are not joined. For that reason, with the technology disclosed in Patent Document 1, the inside of the package body does not have adequate air-tightness. When this technology is applied to a wet tissue package, the wet tissues stored inside this package body will dry out over time.

Therefore, an object of the present invention is to provide a wet tissue package that can easily be produced with a used wet tissue storage receptacle disposed on the package body, and that prevents wet tissues stored in the package body from drying, and a production method of the wet tissue package.

Means for Solving the Problems

The present invention relates to a wet tissue package equipped with a package body that stores a plurality of wet tissues, and a used wet tissue storage receptacle disposed on an outer side of the package body. The package body is equipped with a first seal portion formed by joining a pair of first side edges of a sheet member, and a pair of second seal portions formed by joining a pair of second side edges that extends in a direction that intersects the pair of first side edges of the seal member formed with the first seal portion. The package is also equipped with a wet tissue housing that houses a plurality of wet tissues. The used wet tissue storage receptacle is composed of the first seal portion, a first seal extension portion formed by extending in a direction that intersects a direction that the first side edges extends from the first seal portion, and the sheet member that composes the package body.

The package body is composed of a solid shape having a top surface and a bottom surface; the first seal portion is preferred to be disposed biased to one side in a direction that the second side edges extend, on the bottom surface of the package body.

Furthermore, it is preferable that a pair of side portions along the direction that the first seal extension portion extends are joined to the pair of second seal portions.

Furthermore, the sheet member is composed of a barrier layer that is composed of a material non-permeable to a gaseous body or liquid, and a first sealant layer composed of thermoplastic resin film, so as to be laminated. An inner surface of the package body is preferred to be composed of the first sealant layer.

Still further, the first seal extension portion is configured by extending a sheet member of one of the sheet members joined together that compose the first seal portion.

Also, the first seal extension portion is composed of a sheet material that is different from the sheet member.

Furthermore, the present invention is a manufacturing method for a wet tissue package equipped with a package body that stores a plurality of wet tissues, and a used wet tissue storage receptacle disposed on an outer side of the package body. The wet tissue manufacturing method includes a wet tissue placing process that places a plurality of wet tissues on a top surface or a bottom surface of a belt-shaped sheet member; a folding back-process that folds back a pair of side edges aligned along a direction of flow of the sheet member placed thereupon with the plurality of wet tissues, to a side placed thereupon with the plurality of wet tissues to enclose the plurality of wet tissues; a first seal-forming process that forms a first seal-forming process that forms a first seal portion that extends in a direction that the sheet member flows, by joining together the pair of side edges of the folded back sheet member, and the first seal extension portion extending in a direction that intersects a direction that the first side edges extend from the first seal portion; and a second seal-forming process that forms a pair of second seal portions by joining an upstream side and a downstream side of positions placed with the plurality of wet tissues on the sheet member that has completed the first seal-forming process, so that they extend in a width direction of the sheet member, and that forms the used wet tissue storage receptacle using the sheet member that composes the first seal portion, the first seal extension and the package body.

Also, the belt-shaped sheet member is composed of a barrier layer composed of a material non-permeable to a gaseous body or liquid, and a first sealant layer composed of thermoplastic resin film, so as to laminate. It is preferred that at the wet tissue placing process, the plurality of wet tissues is placed on the first sealant layer side; and that the first seal portion and the second seal portions are formed by a thermal-compression bonding process at the first seal-forming process and the second seal-forming process.

Also, it is preferred that the first seal extension portion is formed at the first seal-forming process by one sheet member of the sheet members that compose the first seal portion being extended, and that a pair of side portions along a direction that the first seal extension portion extends is joined to the pair of second seal portions, in the second seal-forming process.

Furthermore, it is preferred that the first seal extension portion is formed by a sheet material composed of a material that is different from the sheet material being joined to the sheet member that composes the first seal portion, in the first seal-forming process.

Effects of the Invention

Pursuant to the wet tissue package of the present invention, it is possible easily to produce a used wet tissue storage receptacle disposed on the package body, and to prevent wet tissues stored in the package body from becoming dry. Furthermore, pursuant to the production method of the wet tissue package according to the present invention, it is possible efficiently to produce the wet tissue package according to the present invention.

PREFERRED MODE FOR CARRYING OUT THE INVENTION

The following will now explain preferred embodiments of the present invention with reference to the drawings provided.

The first embodiment of the wet tissue package according to the present invention will now be described with reference to FIGS. 1 to 6.

Figure 1:
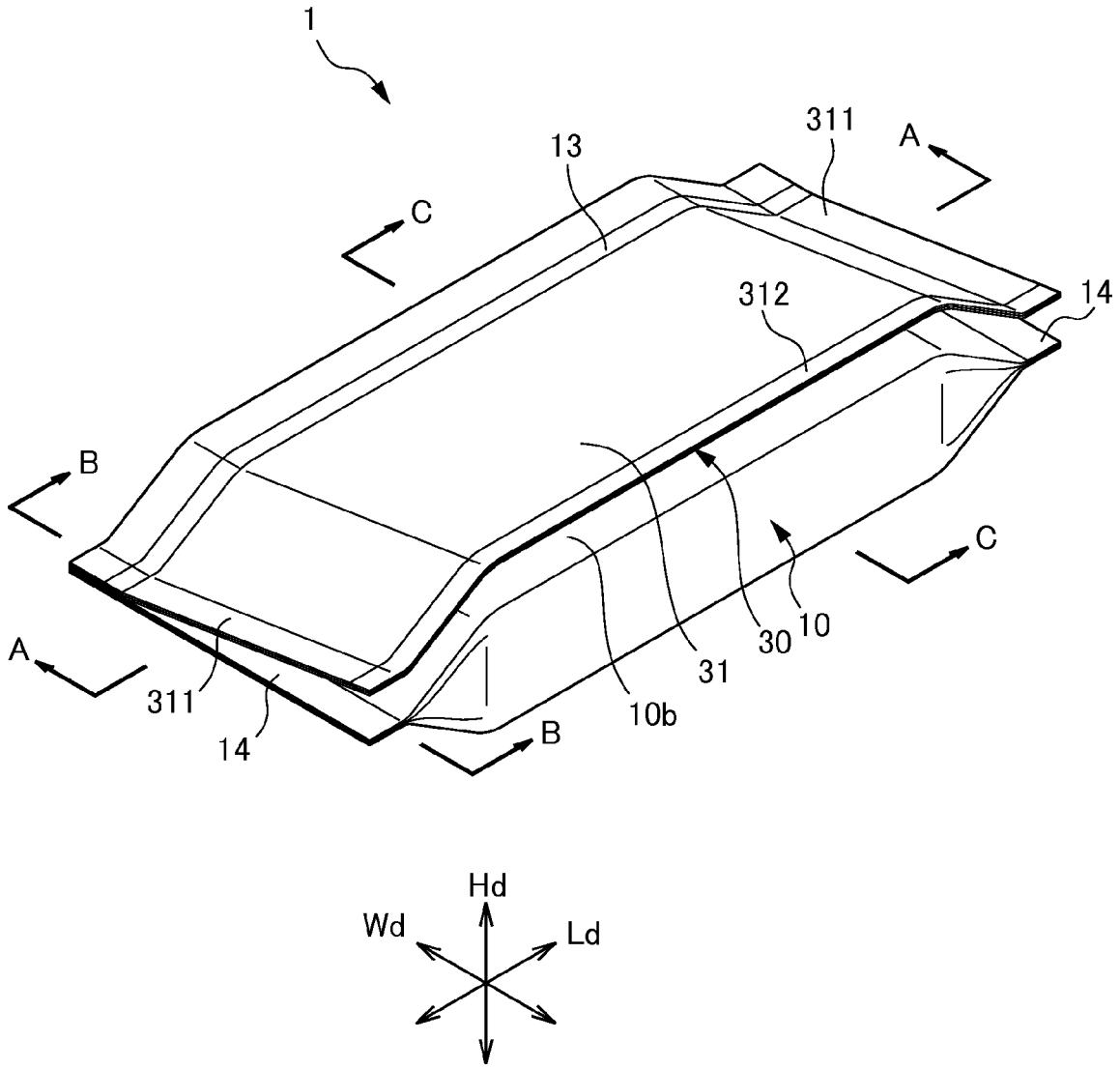
FIG. 1 is a perspective view of a first embodiment of a wet tissue package according to the present invention, looking from a bottom surface side thereof.
Figure 2:
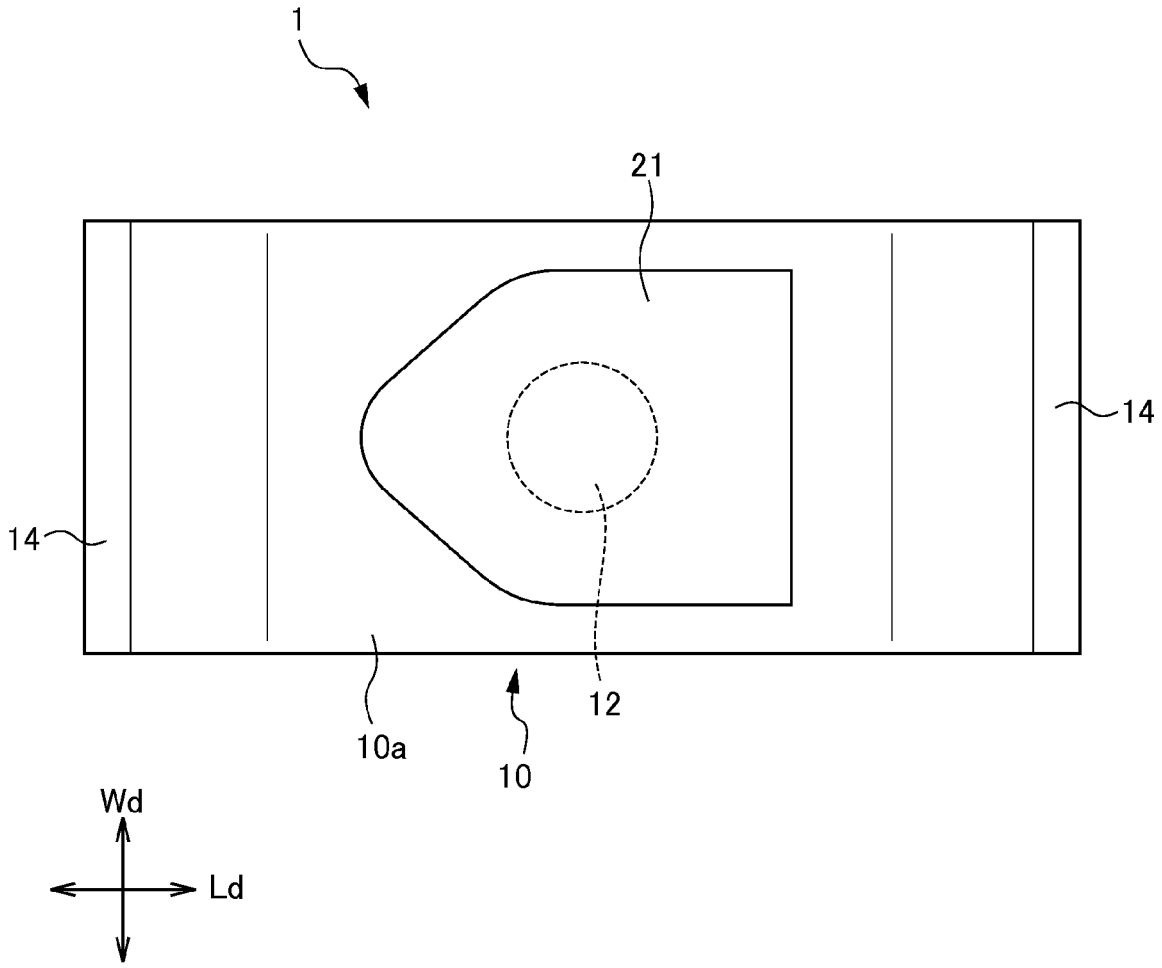
FIG. 2 is a plan view of a wet tissue package according to the first embodiment.
Figure 3:
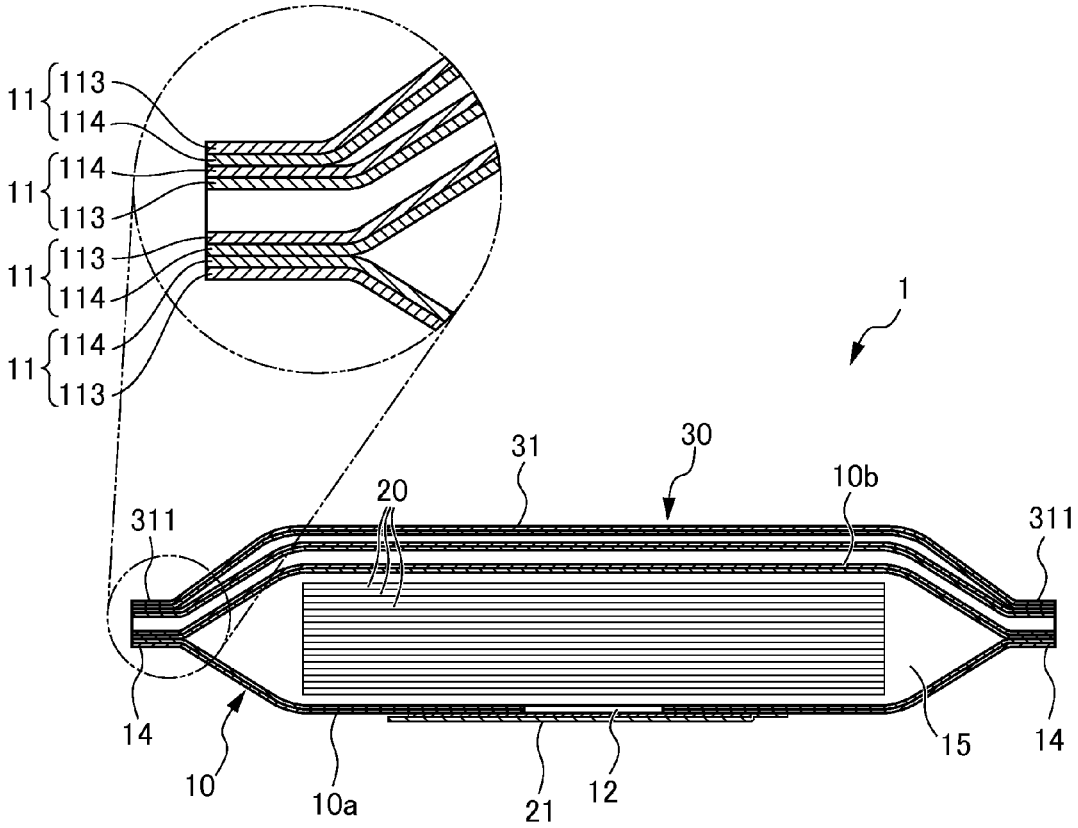
FIG. 3 is a sectional view at intersecting line A-A of FIG. 1.

As shown in FIGS. 1 to 3, the wet tissue package according to the first embodiment is equipped with a package body 10; a plurality of wet tissues 20 stored in an overlapped state in the package body 10; a label 21 attached to an outer surface of the package body 10; and a used wet-tissue storage receptacle 30 that can store used wet tissues.

Figure 4:
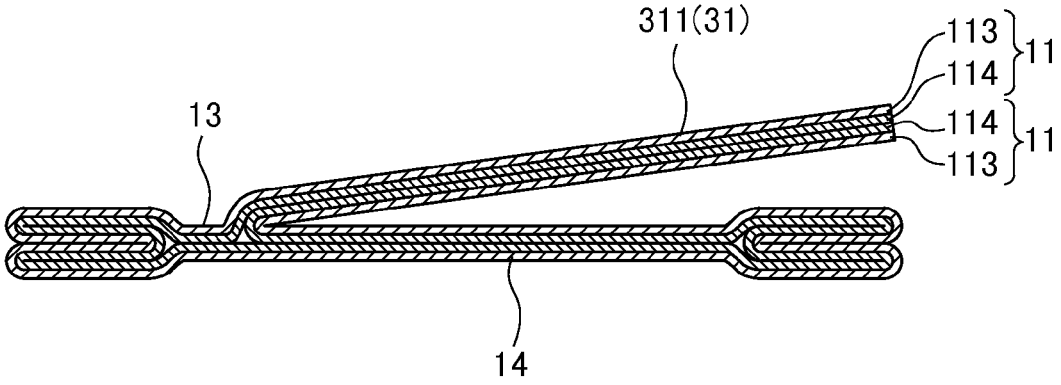
FIG. 4 is a sectional view at intersecting line B-B of FIG. 1.
Figure 5:
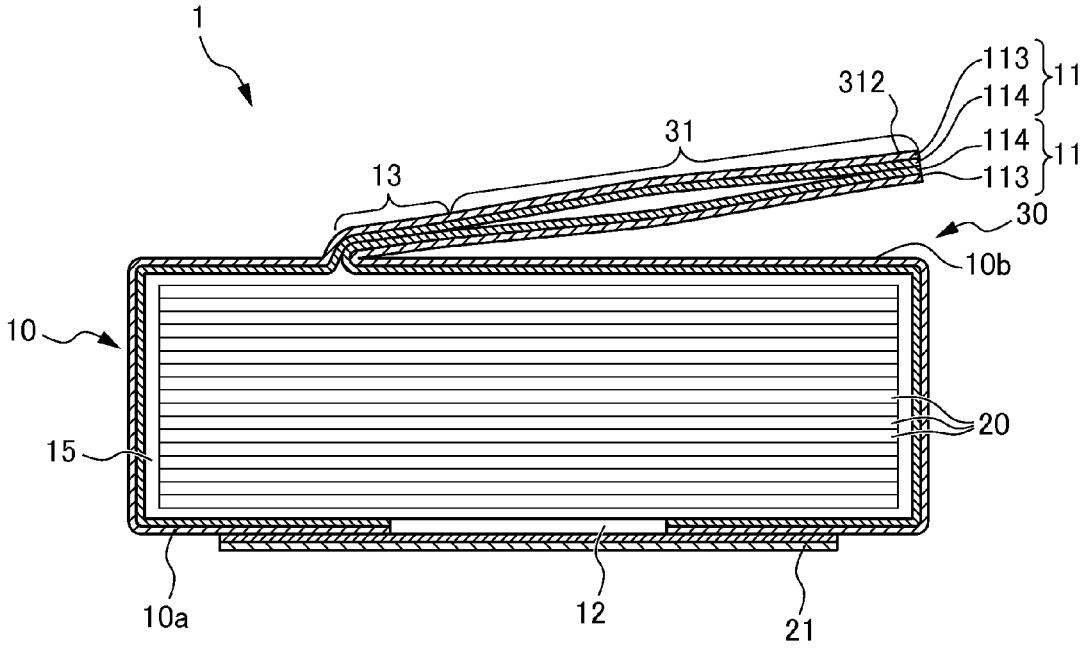
FIG. 5 is a sectional view at intersecting line C-C of FIG. 1.

As shown in FIGS. 3-5, the package body 10 is composed of sheet member 11. More specifically, the package body 10 is composed by the sheet member 11 being folded back to enclose the plurality of wet tissues 20; predetermined portions of the folded back sheet member 11 are joined.

As shown in FIGS. 1 and 2, the package body 10 has a top surface 10*a* and a bottom surface 10*b*. In a plan view (from the top surface), the package body 10 is a solid package having a substantially rectangular shape.

As shown in FIGS. 1 to 3, the package body 10 is equipped with an opening 12 for pulling out wet tissues 20; a center seal 13 that is a first seal portion; a pair of end seals 14 that is a pair of second seal portions; and a wet tissue housing 15 (see FIG. 3) that stores a plurality of wet tissues 20.

As shown in FIG. 2, the opening 12 is disposed substantially at a center of the top surface 10*a* of the package body 10. The opening 12 is formed with a portion cut out of the sheet member 11 that composes the package body 10.

As shown in FIGS. 1 and 5, the center seal 13 is disposed at the bottom surface 10*b* of the package body 10, and extends along a longitudinal direction Ld of the package body 10. The center seal 13 is disposed at a position biased to one side of bottom surface 10*b* in a width direction Wd of the package body 10.

The center seal 13 is formed by mutually bonding a pair of first side edge 111 (see FIG. 8, described below) of the sheet member 11. More specifically, the pair of first side edges 111 of the sheet member 11 that is folded back to enclose the stacked plurality of wet tissues 20, is overlapped. The overlapped portion is joined to form the center seal 13.

As shown in FIGS. 1 to 3, the pair of end seals 14 composes sides that extend in the lateral direction Wd of the package body 10. The pair of end seals 14 is formed by joining each of the pair of second side edges 112 that extend in a direction perpendicular to the pair of first side edges 111 of the sheet member 11 which is in a state that the center seal 13 is formed.

As shown in FIGS. 3 and 5, the wet tissue housing 15 is composed of an enclosed space formed by the sheet member 11 joined at the center seal 13 and the pair of end seals 14.

As shown in FIGS. 3 to 5, the sheet member 11 that composes the package body 10 includes a barrier layer 113 that is non-penetrable to a gaseous body and liquid, and a first sealant 114 composed of a thermoplastic resin film.

Examples of a member that is non-penetrable to air and liquid that composes the barrier layer 113 are aluminum foil, polyethylene terephthalate (PET) film and a film member and the like formed by vapor deposition of aluminum onto the PET film.

The thermoplastic resin film that composes the first sealant layer 114 is composed of a fusion-bonded resin that melts at a predetermined temperature and pressure. Examples of thermoplastic resins that can compose the first sealant layer 114 include polypropylene and polystyrene polymer alloy, polyethylene, polypropylene and polystyrene polymer alloy, blended resins of polypropylene and polyethylene, and blended resins of polypropylene and elastomer and the like.

As shown in FIGS. 3 to 5, with the first embodiment, the package body 10 is composed by disposing the sheet member 11 so that the first sealant layer 114 composes inner surfaces. Also, with the first embodiment, the center seal 13 and the pair of end seals 14 are formed by joining together the first sealant layers 114 that composes the inner surfaces of the package body 10, using thermal compression treatment (heat seal).

The following will now explain the used wet-tissue storage receptacle 30.

As shown in FIGS. 1 and 3, the used wet-tissue storage receptacle 30 is disposed at an outer surface (the bottom surface 10*b*) of the package body 10.

With the first embodiment, the used wet-tissue storage receptacle 30 is composed of the center seal 13, a center seal extension 31 that is a first seal extension portion, and the sheet member 11 that composes the bottom surface 10*b* of the package body 10.

As shown in FIGS. 1, 3 and 5, the center seal extension 31 extends along the bottom surface 10*b* of the package body 10, and toward the other side (an opposite side to a side where the center seal 13 is positioned in the width direction Wd of the package body 10) in the width direction Wd of the package body 10. Also, the position of the leading end 312 of the center seal extension 31 substantially matches the position of side edge at the other side in the width direction Wd of the bottom surface 10*b* of the package body 10, at a thickness direction Hd of the package body 10; the positions of a pair of side portions 311 substantially match the position of the pair of end seals 14, at a thickness direction Hd of the package body 10.

As shown in FIGS. 1 and 5, the center seal extension 31 is formed by extending in a direction that intersects the direction (the longitudinal direction Ld of the package body 10) in which the sheet member 11 that composes the center seal 13 extends from the center seal 13 to the first side edge 111. As shown in FIGS. 3 to 5, the center seal extension 31 is composed by the two-layered sheet member 11 being joined by heat sealing at the pair of side portions 311 that extend in directions that intersect the direction (a first side edge 111 extending direction) that the center seal 13 extends, and at the leading end portion 312 extending along the direction that the center seal 13 extends. In other words, the two-layered sheet member 11 that composes the center seal extension 31 is not joined at areas other than the pair of side portions 311 and the leading end portion 312.

The leading end portion 312 of the center seal extension 31 can separate from the bottom surface 10*b* of the package body 10; the pair of side portions 311 can separate from the pair of end seals 14. (See FIGS. 3 and 4).

The wet-tissue storage receptacle 30 that can store used wet tissues is formed between the face of the bottom surface 10*b* side of the package body 10 in the center seal 13 and the center seal extension 31, and the bottom surface 10*b* of the package body 10.

A plurality of wet tissues 20 is formed into a substantially square shape. Each of the plurality of wet tissues 20 is folded and stacked in a predetermined shape to be stored in the package body 10. (See FIGS. 3 and 5.)

As shown in FIG. 2, one end in the length direction in the substantially rectangular shape of the label 21 has an arc shape. This label 21 is detachably glued to a surrounding edge of the opening 12 at the top surface 10*a* of the package body 10.

The label 21 is composed of a synthetic resin film such as polyethylene, polypropylene, polyester, polyamide, or polyvinyl chloride and the like. Furthermore, the label 21 can be structured to have a plurality of layers including two more stacked layers of synthetic resin films.

Figure 6:
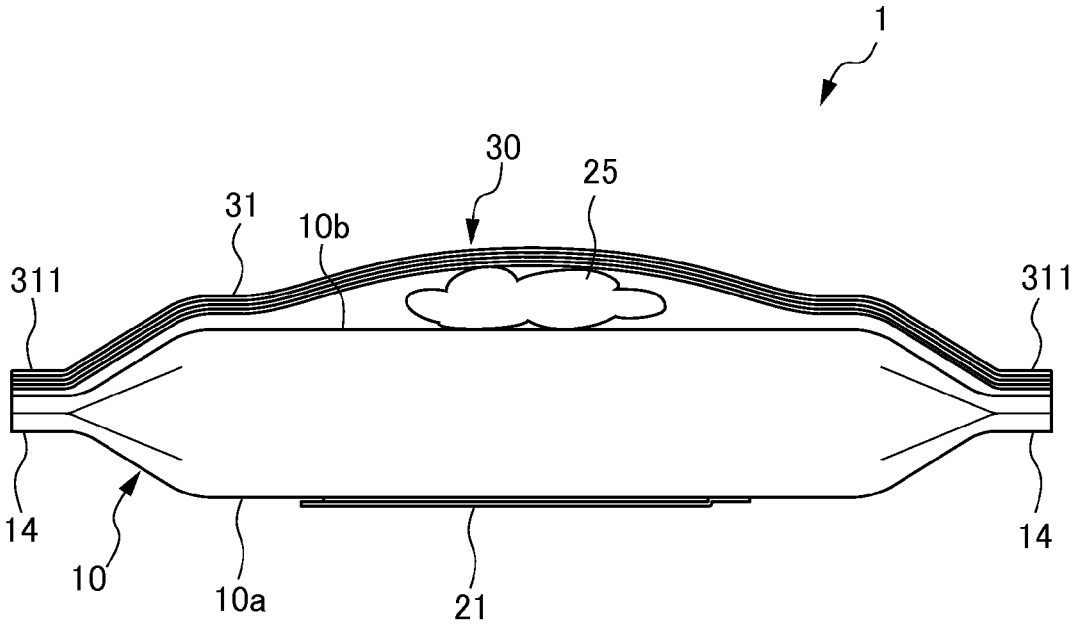
FIG. 6 is a side view of the wet tissue package according to the first embodiment in use.

FIG. 6 is a side view of the wet tissue package according to the first embodiment in use.

As shown in FIG. 1, in the wet tissue package 1 of the first embodiment, the center seal extension 31 is positioned along the bottom surface 10*b* of the package body 10, without used wet tissues 25 being stored in the used wet-tissue storage receptacle 30. In other words, the used wet-tissue storage receptacle 30 is in a closed state.

However, after a wet tissue 20 is used, the used wet tissue 25 is placed in the used wet-tissue storage receptacle 30. To store used wet tissues 25 in the used wet-tissue storage receptacle 30, the user pushes the used wet tissues 25 between the bottom surface 10*b* of the package body 10 and the center seal extension 31, from the leading end portion 312 of the center seal extension 31. (See FIG. 6.)

When doing so, a space between the leading end portion 312 of the center seal extension 31 and bottom surface 10*b* of the package body 10 separates.

Here, a plurality of wet tissues 20 is stored in the package body 10. For that reason, the package body 10 is thicker than that of the pair of end seals 14. Also, the sheet member 11 that composes the package body 10 and the center seal extension 31 has a predetermined rigidity. With this, even if the space between the leading end portion 312 of the center seal extension 31 and the bottom surface 10*b* of the package body 10 separates, it is difficult for a force in the direction to separate the center seal extension 31 from the bottom surface 10*b*, to be transmitted to the pair of side portions 311. For that reason, the pair of side portions 311 of the center seal extension 31 does not separate much from the pair of end seals 14 (see FIG. 6). Therefore, when used wet tissues 25 are stored in the used wet-tissue storage receptacle 30, the used wet tissues 25 are properly held between the center seal extension 31 and the bottom surface 10*b* of the package body 10.

Figure 7:
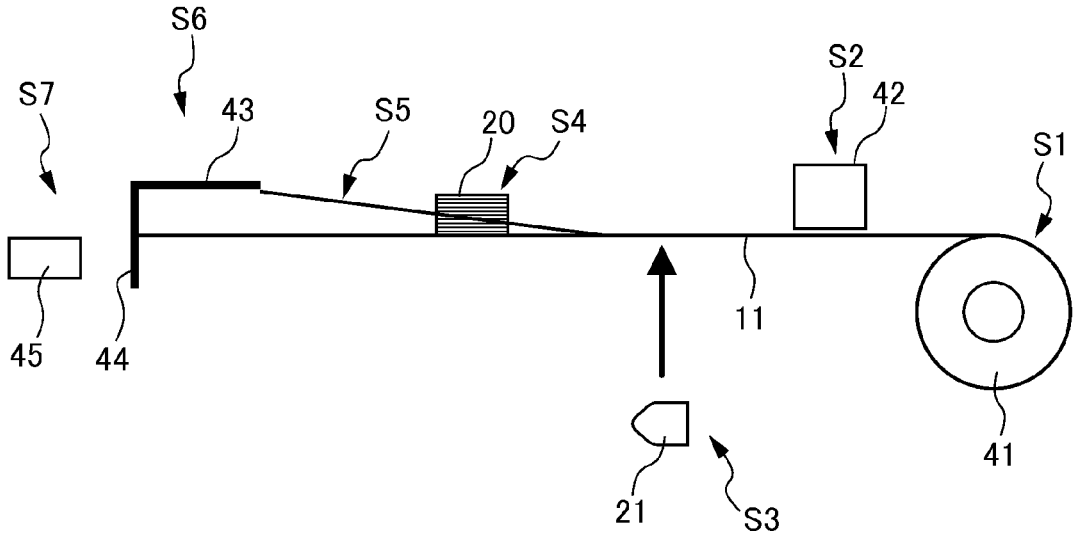
FIG. 7 is a schematic view of production processes for the wet tissue package according to the first embodiment.
Figure 8:
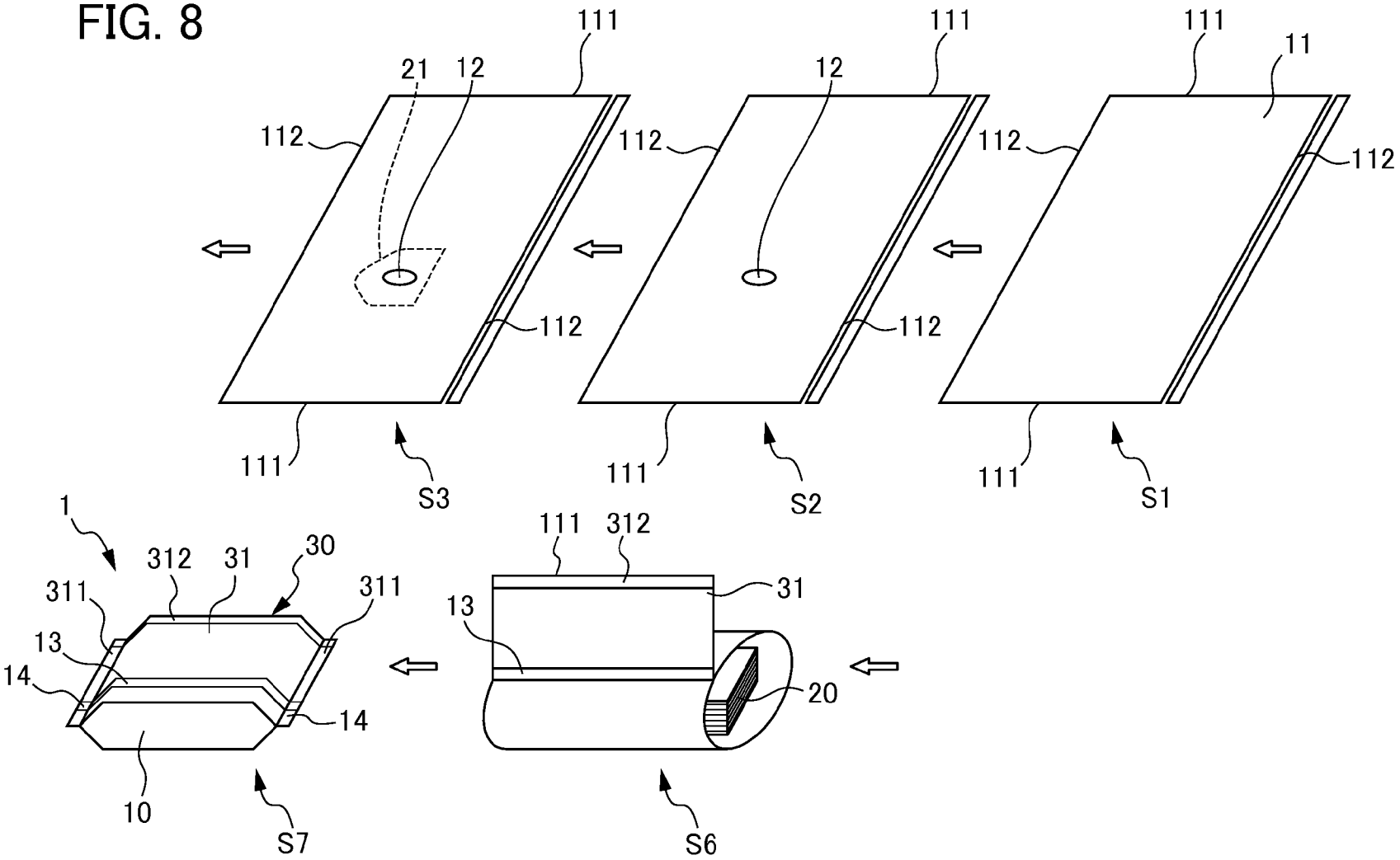
FIG. 8 is a perspective view of each process shown in FIG. 7.

The first embodiment, which is the preferred embodiment of a production method of the wet tissue package 1 of the first embodiment, will now be described with reference to FIGS. 7 to 8. FIG. 7 is a schematic view of a production method of the wet tissue package 1 according to the first embodiment. FIG. 8 is a perspective view of each process in the production method of the wet tissue package according to the first embodiment.

As shown in FIGS. 7 to 8, the production method of the wet tissue package 1 according to the first embodiment is equipped with a feeding process S1; a hole-forming process S2; a label-attaching process S3; a wet-tissue placing process S4; a folding-back process S5; a center-seal forming process S6 that is a first seal-forming process, and an end-seal forming process S7 that is a second seal-forming process.

At the feeding process S1, a belt-shaped sheet member 11 is fed from a feeding unit 41. Then, a first sealant layer 114 is fed to form a top surface over the belt-shaped sheet member 11.

Then, at the hole-forming process S2, a hole 12 is formed by a first cutting unit 42, in the belt-shaped sheet member 11.

At the label-attaching process S3, the label 21 is attached from an under side of the belt-shaped sheet member 11 formed with the opening 12. This label 21 is attached to cover the hole 12.

At the wet-tissue placing process S4, a plurality of folded and stacked wet tissues 20 is placed on the top surface side of the belt-shaped sheet member 11 whose hole 12 is covered by the label 21.

At the folding-back process S5, the sheet member 11 with the plurality of wet tissues 20 placed on a top surface side thereof is folded back thereby enclosing therein the plurality of wet tissues 20. More specifically, the pair of first side edges 111 is folded back to a side where the plurality of wet tissues 20 is placed (the top surface side) in the direction that the belt-shaped sheet member 11 flows, thereby covering the plurality of wet tissues 20.

Then, at the center-seal forming process S6, the center seal 13 and the center seal extension 31 are formed by a first heat-sealing unit 43. More specifically, at the center-seal forming process S6, a thermal-compression bonding process is implemented by the first heat-sealing unit 43, on the pair of first side edges 111 of the belt-shaped sheet member 11 overlapped and folded so that positions of the pair of first side edges 111 match. With this, the sheet members 11 are joined with the first sealant layers 114 mutually fused and overlapped, at the portion where the sheet members 11 overlap. Also, the center seal 13 that extends in the direction of sheet member 11 flow is formed at the base end of a portion where the sheet member 11 overlaps, and the center seal extension 31 is formed to extend from the center seal.

As shown in FIG. 8, the center seal 13 is formed biased to one side in the direction that intersects a direction of the belt-shaped sheet member 11 flows (the width direction). Also, when the center seal 13 and the center seal extension 31 are formed at the center-seal forming process S6, the upstream and downstream sides of the sheet member 11 are open in the direction that the sheet member 11 flows (see FIG. 8).

At the end-seal forming process S7, the pair of end seals 14 and the used wet-tissue storage receptacle 30 are formed by a second heat-sealing unit 44. More specifically, at the end-seal forming process S7, the thermal-compression bonding process is implemented by the second heat-sealing unit 44 extending in the width direction of the sheet member 11, at upstream and downstream sides of the positions where the plurality of wet tissues 20 are disposed on the belt-shaped sheet member 11 which is formed with the center seal 13 and the center seal extension 31.

With this, the pair of end seals 14 is formed by joining the open portions at the upstream and downstream sides in the direction that the sheet member 11 flows, thereby forming the package body 10. Also, the center seal extension 31 is positioned along the bottom surface 10*b* of the package body 10 oblique to the other side (an opposite side to that where the center seal 13 is formed) in the sheet member 11 width direction, by the thermal-compression bonding process implemented by the second heat sealing unit 44. Also, the two-layer sheet member 11 is joined at the pair of side portions 311 (see FIG. 4), that extend in a direction that intersects the direction of sheet member 11 flow on the center seal extension 31.

In this way, the used wet-tissue storage receptacle 30 is formed by the center seal 13, the center seal extension 31, and the bottom surface 10*b* of the package body 10.

Also, at the end-seal forming process S7, the wet tissue package 1 is produced by a second cutter 45 cutting a continuous body of the wet tissue package 1 formed with the pair of end seals 14 and the used wet-tissue storage receptacle 30. More specifically, the continuous body of the wet tissue package 1 is cut in a width direction at a position where the end seals 14 are formed.

At the end-seal forming process S7, the thermal-compression bonding process implemented by the second heat seal unit 44, and the cutting process implemented by the second cutting unit 45 are implemented substantially simultaneously.

Effects of the wet tissue package 1 of the first embodiment, and the production method of wet tissue package 1 will now be described.

(1) The package body 10 configuration includes the center seal 13 and the pair of end seals 14; the used wet-tissue storage receptacle 30 is composed of the center seal extension 31 that is formed to extend from the center seal 13. With this, the used wet-tissue storage receptacle 30 can be produced by using the center seal extension 31 that extends from the center seal 13 which is a part of the package body 10. For that reason, it is simple to produce the wet tissue package 1 equipped with the used wet-tissue storage receptacle 30. Also, because the wet tissue housing 15 can be sealed closed by the center seal 13 and the pair of end seals 14, the wet tissues 20 stored in the package body 10 are prevented from drying.

(2) The center seal 13 is disposed at a position biased to one side at the bottom surface 10*b* of the package body 10. With this, it is possible to produce a large-capacity used wet-tissue storage receptacle 30 configured to include the center seal extension 31, so the storage capacity for used wet tissues is increased.

(3) The sheet member 11 is composed of two layers, namely the barrier layer 113 and the sealing layer 114; the sealing layer 114 configures the inner surface of the package body 10. This makes it possible easily to form the center seal 13 and the end seals 14 using the thermal-compressing bonding process. Therefore, the center seal 13 and the end seals 14 can be formed without using an adhesive or glue or the like, so the wet tissue package 1 can be produced efficiently.

(4) The center-seal forming process S6 forms the center seal 13 and center seal extension 31; the end-seal forming process S7 forms the end seals 14; the used wet-tissue storage receptacle 30 is formed by the center seal 13, the center seal extension 31, and the bottom surface 10*b* of the package body 10. Therefore, it is possible to produce the wet tissue package 1 that includes the used wet-tissue storage receptacle 30 without implementing a separate process for forming the used wet-tissue storage receptacle 30. For that reason, the efficiency of producing the wet tissue package 1 is improved.

Figure 9:
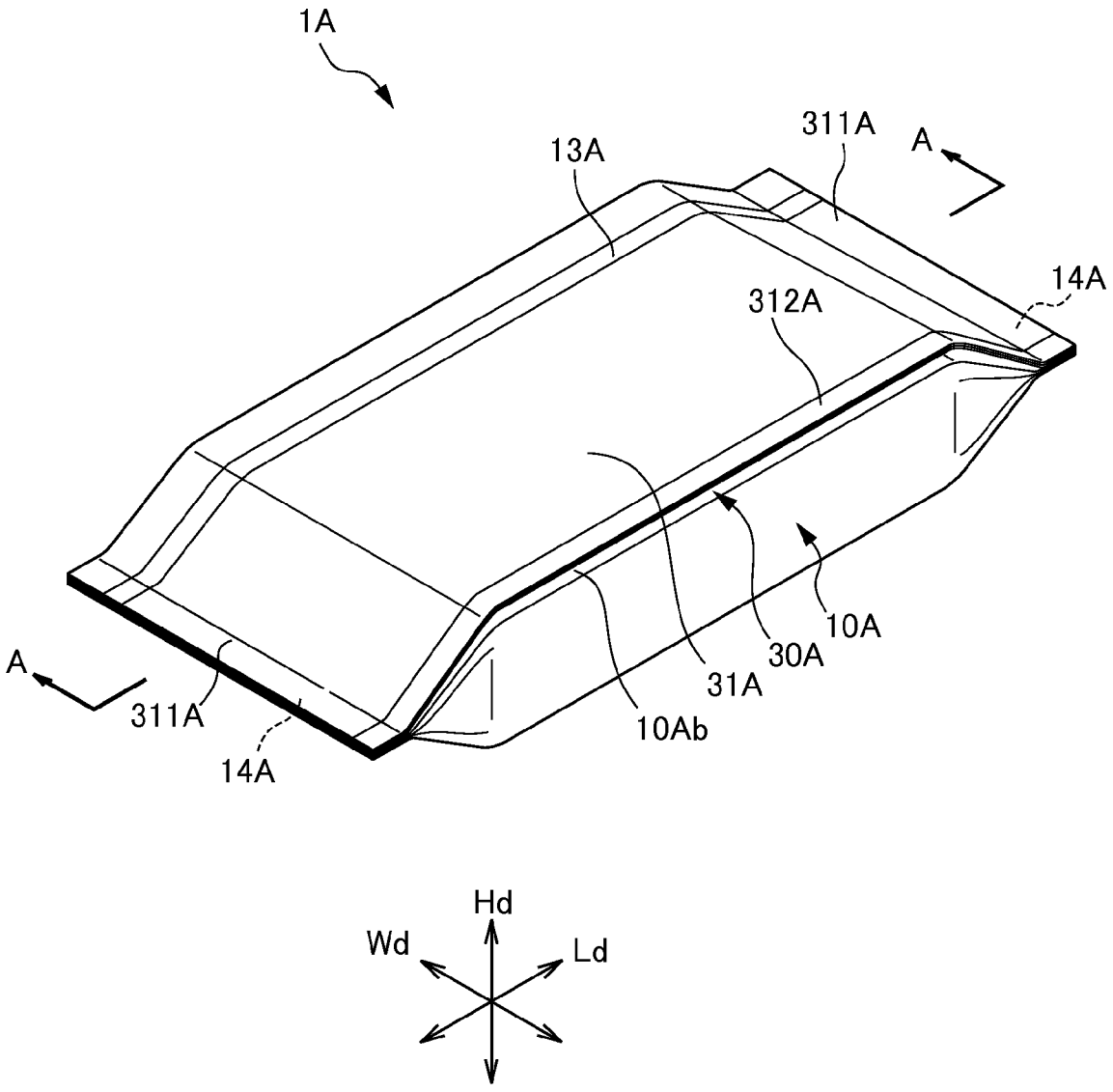
FIG. 9 is a perspective view of a second embodiment of the wet tissue package, looking from a bottom surface side thereof.
Figure 10:
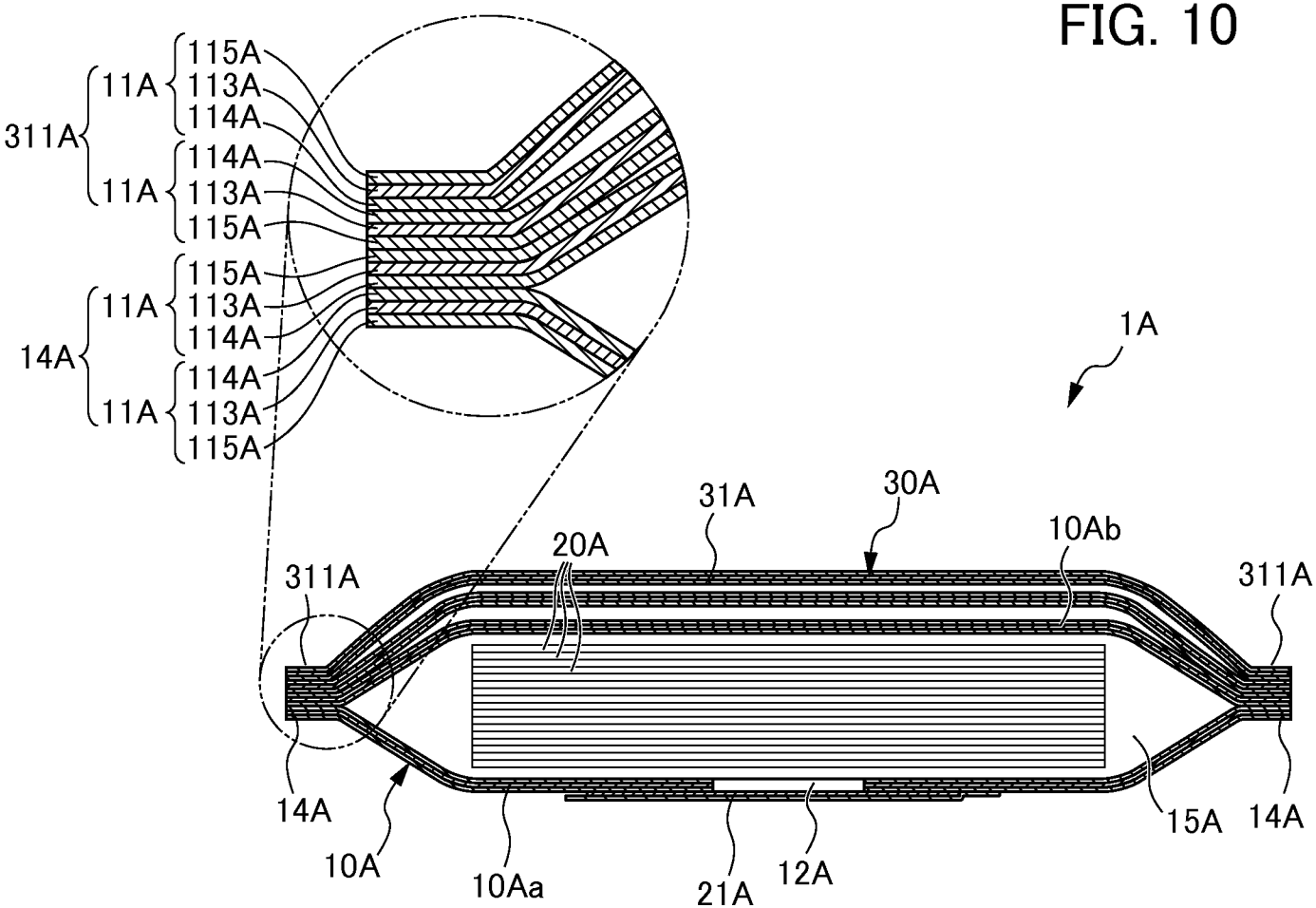
FIG. 10 is a sectional view at intersecting line A-A of FIG. 9.

Next, a second embodiment of the wet tissue package according to the present invention will now be described with reference to FIGS. 9 and 10. FIG. 9 is a perspective view of the wet tissue package 1A according to the second embodiment, looking from a bottom surface side thereof. FIG. 10 is a sectional view at intersecting line A-A of FIG. 9. Note that to describe the second embodiment, the same symbols are adopted to refer to the same configuring elements. For that reason, explanations of those elements will be omitted to simplify the description.

The wet tissue package 1A according to the second embodiment differs from that of the first embodiment mainly in the configuration of a sheet member 11A and a used wet tissue storage receptacle 30A.

More specifically, as shown in FIG. 10, with the wet tissue package 1A according to the second embodiment, the sheet member 11A is equipped with a barrier layer 113A; a first sealant layer 114A disposed at an inner surface side which is one surface of this barrier layer 113A; and a second sealant layer 115A disposed at an outer surface side which is another surface of this barrier layer 113A. The second sealant layer 115A is composed of a material that is the same as the first sealant layer 114A.

Furthermore, the pair of side portions 311A is joined to the pair of end seals 14A, on the center seal extension 31A, as shown in FIGS. 9 and 10. More specifically, with the second embodiment, the second sealant layer 115A that composes the outer surface of the end seals 14A, and the second sealant layer 115A that composes the surface that opposes the end seals 14A at the side portions 311A of the center seal extension 31A are joined by heat sealing, in the end-seal forming process S7.

In this way, with the second embodiment, the center seal extension 31A is joined to the package body 10*a* at the three locations (three sides), namely the center seal 13A, and the pair of side portions 311A. In other words, with the second embodiment, the used wet tissue storage receptacle 30A is formed as a space that is open at one side, and closed at three sides.

In addition to the effects of (1) to (4) described above, the wet tissue package 1A pursuant to the second embodiment also has the following effects.

(5) The pair of side portions 311A on the center seal extension 31A is each joined to the end seals 14A. With this, three sides of the used wet tissue storage receptacle 30A can be closed. Therefore, it is difficult for used wet tissues stored in the used wet tissue storage receptacle 30A to fall out.

(6) The sheet member 11A is configured to include the second sealant layer 115A disposed at another surface side of the barrier layer 113A. With this, the pair of side portions 311A on the center seal extension 31A is joined to the end seals 14A by heat sealing, in the end-seal forming process S7. Therefore, the joining of the pair of side portions 311A and the pair of end seals 14A can be implemented without disposing a separate process. For that reason, it is simple to produce a wet tissue package 1A that includes a used wet tissue storage receptacle 30A that is closed on three sides.

Figure 11:
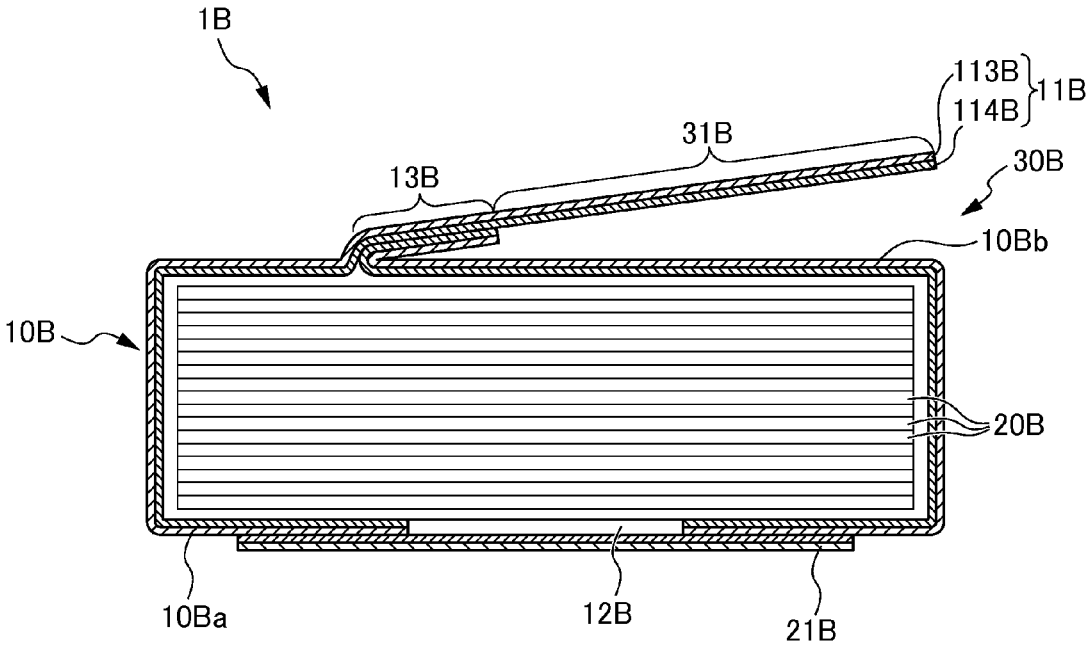
FIG. 11 is a sectional view of a wet tissue package according to a third embodiment, corresponding to FIG. 5.

Next, a third embodiment of the wet tissue package according to the present invention will now be described with reference to FIG. 11. FIG. 11 is a sectional view of a wet tissue package 1B according to the third embodiment. The drawing corresponds to a sectional view at intersecting line C-C of FIG. 1.

The wet tissue package 1B according to the third embodiment differs from that of the first embodiment in the configuration of a center seal extension 31B. More specifically, as shown in FIG. 11, with the third embodiment, the sheet members 11B mutually joined to form the center seal 13B, one sheet member 11B that is positioned at an outer side is configured to extend outward for the center seal extension 31B. In other words, the center seal extension 31B is composed of one layer of sheet member 11B, the one layer of sheet member 11B being composed of a inner surface opposing the bottom surface 10Bb of the package body 10B and configured by the first sealant layer 114B, and a outer surface configured by the barrier layer 113B.

In this way, in the wet tissue package 1B according to the third embodiment, the inner surface of the center seal extension 31B is composed of the first sealant layer 114B. For that reason, the end seals 14B, and the side portions of the center seal extension 31B are joined by heat sealing them at the end-seal forming process S7.

In addition to the effects of (1) to (5) described above, the wet tissue package 1B pursuant to the third embodiment also has the following effects.

(7) The center seal extension 31B is configured to extend one of the sheet members 11B that is positioned at the outer surface side of the sheet members 11B that are mutually joined to configure the center seal 13B. With this, a surface of the seal extension 31B that touches the bottom surface 10Bb of the package body 10B is configured by the first sealant layer. Therefore, even if the sheet member 11B were composed by a two-layer structure, it is possible to heat seal the pair of side portions 311B of the center seal extension 31B and the pair of end seals 14B without having to dispose a separate member (hot-melt adhesive or adhesive seal) to join the pair of side portions 311B of the center seal extension 31B and the pair of end seals 14B. This results in reducing the number of components and hours associated with the production of the wet tissue package 1B.

Figure 12:
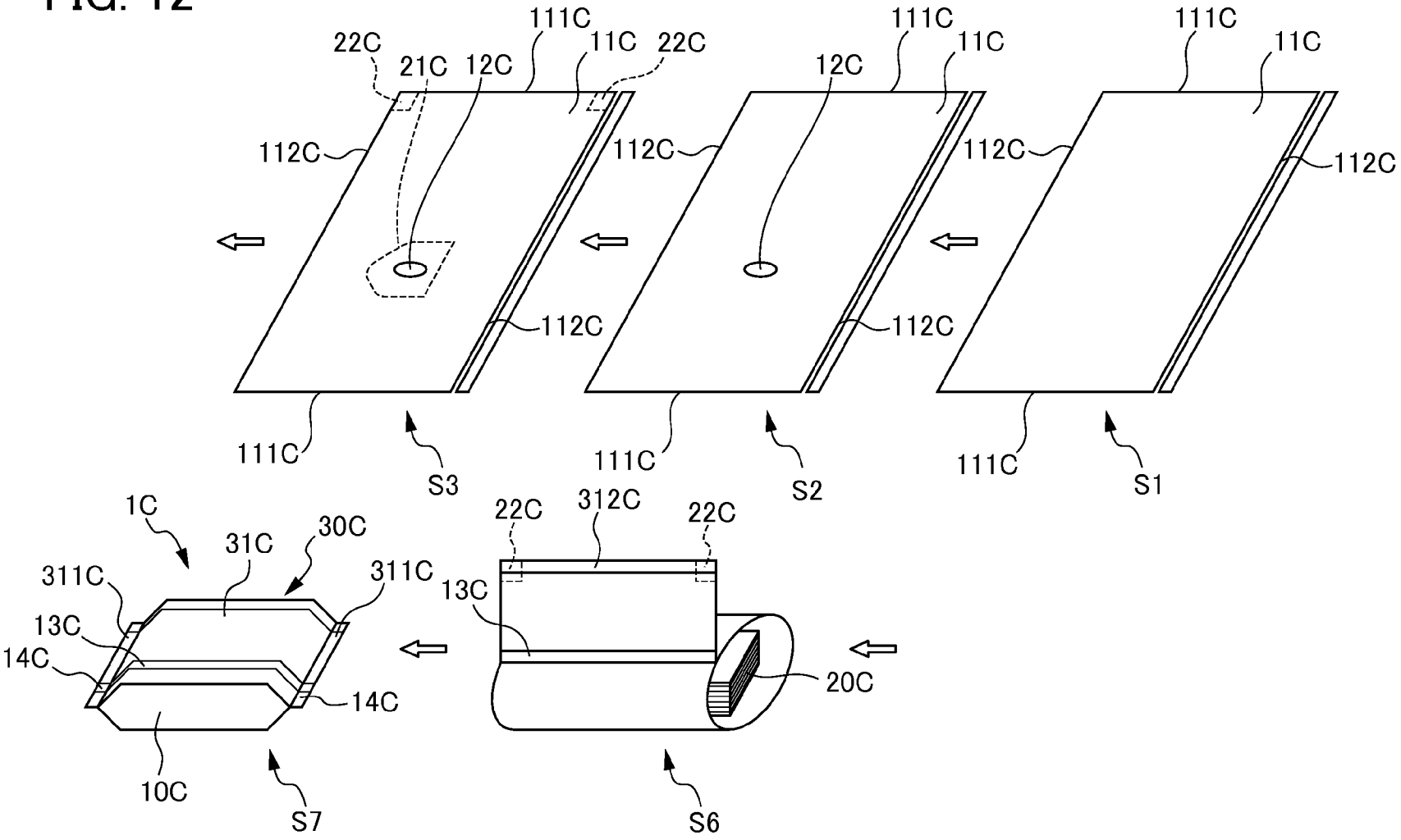
FIG. 12 is a perspective view of each production process of a wet tissue package according to a fourth embodiment.

Next, a fourth embodiment of the wet tissue package according to the present invention will now be described with reference to FIG. 12. FIG. 12 is a perspective view of each production process of a wet tissue package 1C according to the fourth embodiment.

The wet tissue package 1C according to the fourth embodiment differs from that of the first embodiment in that a pair of side portions 311C of the center seal extension 31C and a pair of end seals 14C are joined by adhesive seals 22C. More specifically, in the label-attaching process S3, a label 21C is attached from a bottom surface side of the belt-shaped sheet member 11C formed with a hole 12, and the adhesive seals 22C, such as double-faced tape and the like, is attached to predetermined locations (locations that configure the pair of side portions 311C of the center seal extension 31C) on the bottom surface side of the belt-shaped sheet member 11C. With this, the pair of side portions 311C of the center seal extension 31C and the pair of end seals 14C are joined by the adhesive seals 22C, when the end seals 14C is formed in the end-seal forming process S7.

The wet tissue package 1C pursuant to the fourth embodiment has the effects (1) to (5) described above.

Figure 13:
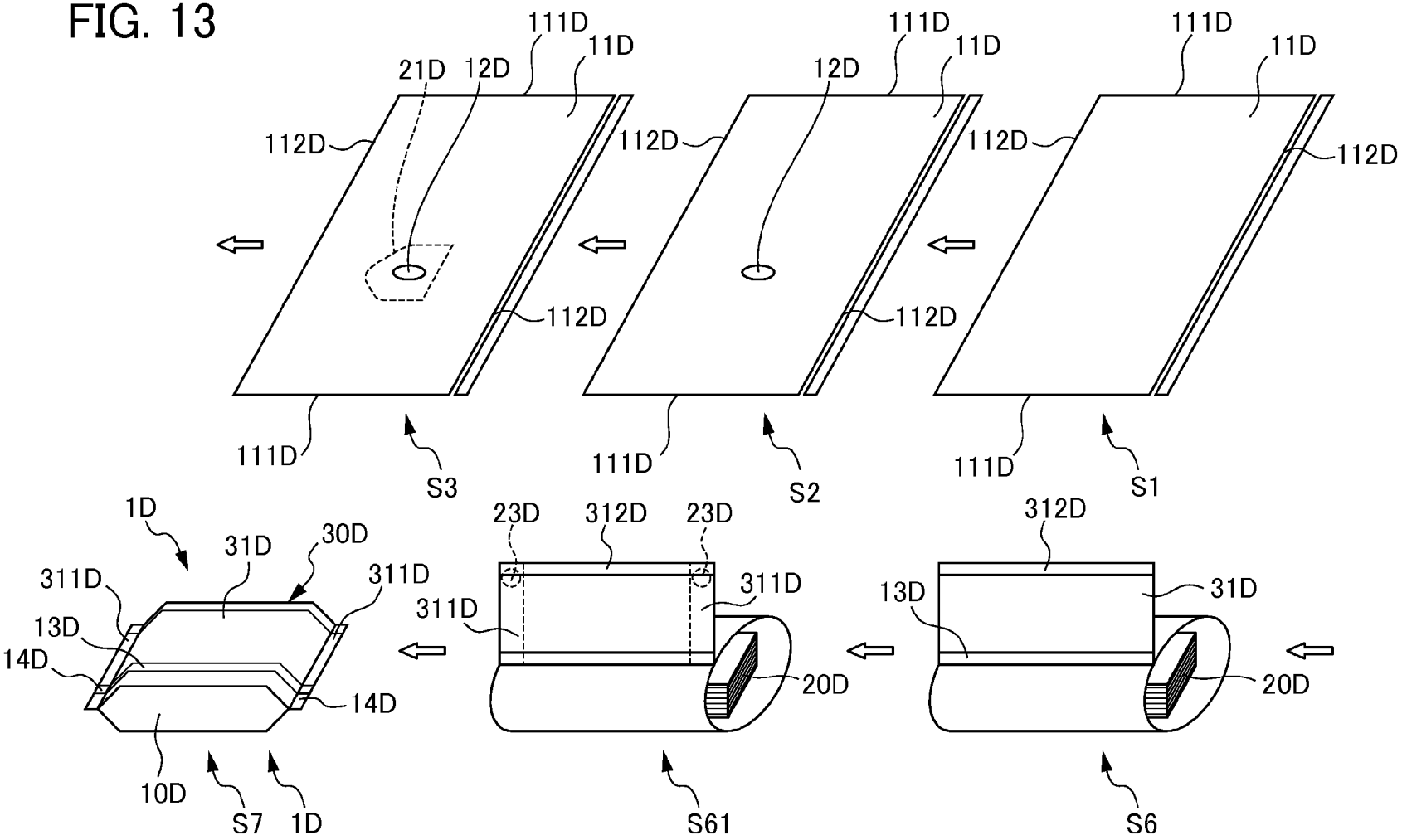
FIG. 13 is a perspective view of each production process of a wet tissue package according to a fifth embodiment.

Next, a fifth embodiment of the wet tissue package according to the present invention will now be described with reference to FIG. 13. FIG. 13 is a perspective view of each production process of a wet tissue package 1D according to the fifth embodiment.

The wet tissue package 1D according to the fifth embodiment differs from that of the first embodiment in that a pair of side portions 311D of the center seal extension 31D and a pair of end seals 14D are joined by hot-melt adhesive 23D. More specifically, with the fifth embodiment, a hot-melt adhesive application process S61 is established between the center-seal forming process S6 and the end-seal forming process S7. With this hot-melt adhesive application process S61, hot-melt adhesive 23D is applied to the pair of side portions 311D of the center seal extension 31D that is formed at the center-seal forming process S6. With this, when the end seals 14D are formed in the end-seal forming process S7, the pair of side portions 311D of the center seal extension 31D and the pair of end seals 14D are joined by hot-melt adhesive 23D.

The wet tissue package 1D pursuant to the fifth embodiment has the effects (1) to (5) described above.

Figure 14:
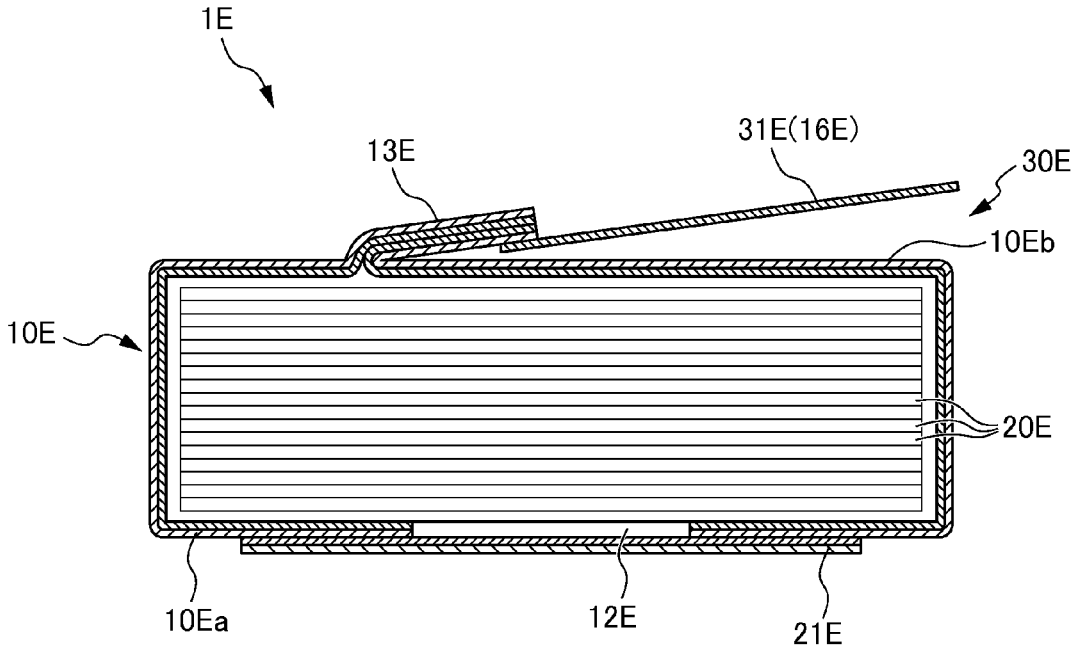
FIG. 14 is a sectional view of a wet tissue package according to a sixth embodiment, corresponding to FIG. 5.
Figure 15:
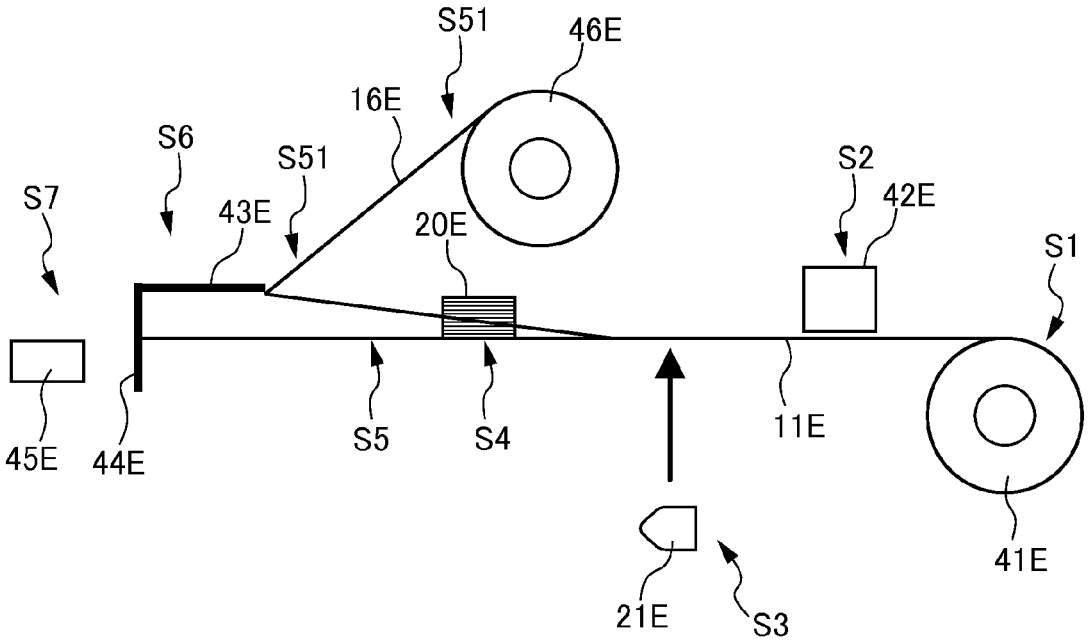
FIG. 15 is a schematic view of production processes for the wet tissue package according to the sixth embodiment.
Figure 16:
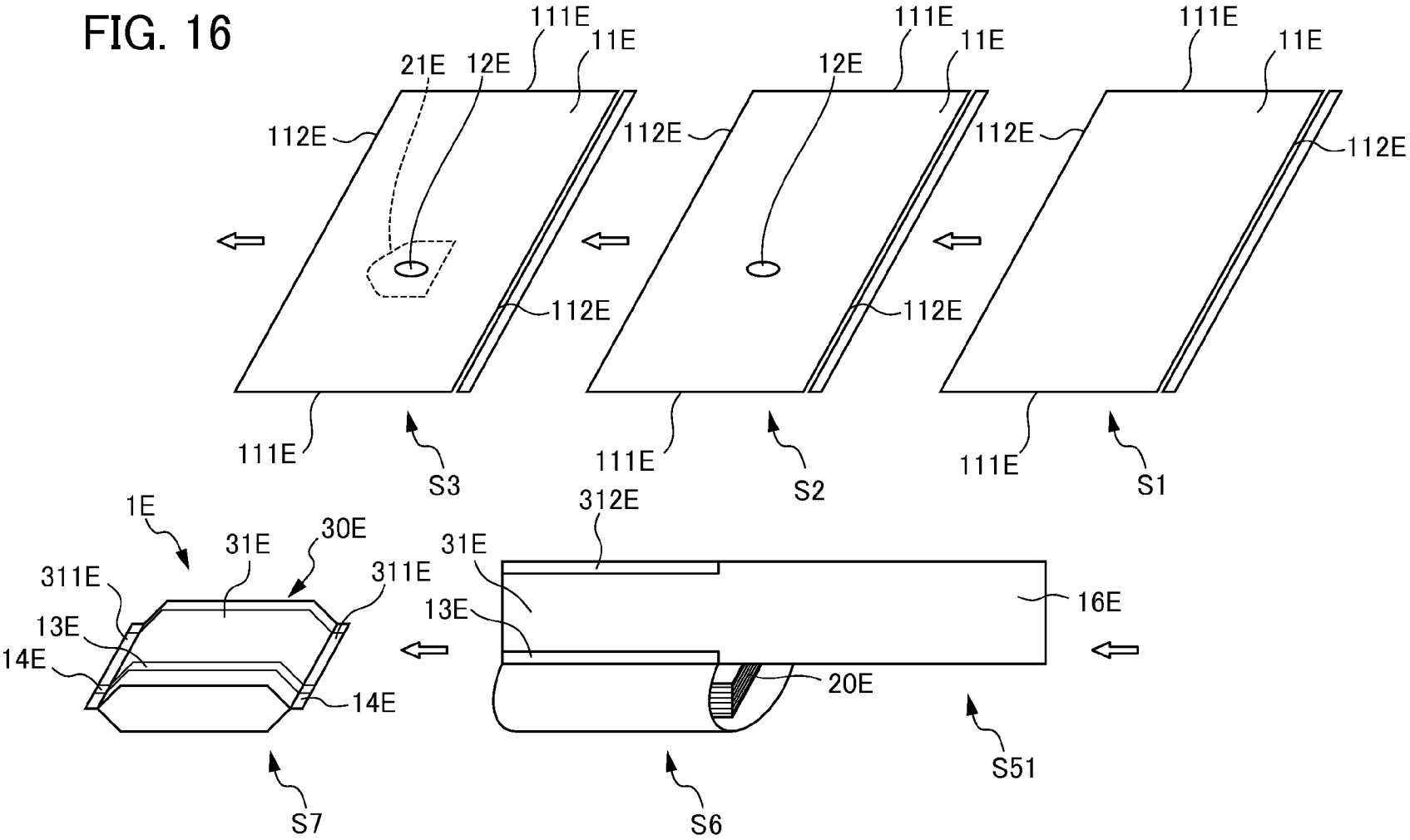
FIG. 16 is a perspective view of each production process of the wet tissue package according to the sixth embodiment.

Next, a sixth embodiment of the wet tissue package according to the present invention will now be described with reference to FIGS. 14 to 16. FIG. 14 is a sectional view of the wet tissue package 1E according to the sixth embodiment. The drawing corresponds to a sectional view at intersecting line C-C of FIG. 1. FIG. 15 is a schematic view of production processes of the wet tissue package 1E according to the sixth embodiment. FIG. 16 is a perspective view of each production process of the wet tissue package 1E according to the sixth embodiment.

The wet tissue package 1E according to the sixth embodiment differs from that of the first embodiment in the configuration of a center seal extension 31E. More specifically, as shown in FIG. 14, with the sixth embodiment, the center seal extension 31E is configured by a sheet material 16E that is a separate body to the sheet member 11E that composes the package body 10E. A base end side of the sheet material 16E is joined to an outer surface of the two-layer sheet member 11E that composes the center seal 13E. The sheet material 16E is composed of an elasticized film member.

As shown in FIGS. 15 and 16, the production method of the wet tissue package 1E according to the sixth embodiment differs from the production method of the wet tissue package 1 of the first embodiment in that that production method is equipped with a second feeding process S51 that feeds the sheet material 16E, disposed between the folding process S5 and the center-seal forming process S6.

With the sixth embodiment, one side edge of the pair of side edges along the direction that the sheet material 16E flows, of the sheet material 16E fed from a second feeding unit 46E in the second feeding process S51 is joined to the center seal 13E. With this, the center seal extension 31E can be composed by the sheet material 16E that has a different material quality than the sheet member 11E that composes the package body 10E.

In addition to the effects of (1) to (4) described above, the wet tissue package 1E pursuant to the sixth embodiment also has the following effect.

(8) The center seal extension 31E can be composed by the sheet material 16E that is a different member than the sheet member 11E that composes the package body 10E. With this, the degree of freedom to select the material quality of the sheet material 16E that composes the used wet tissue storage receptacle 30E is improved. For example, by composing the sheet material 16E using an elasticized film member, the holding ability of used wet tissues in the used wet tissue storage receptacle 30E can be improved.

Figure 17:
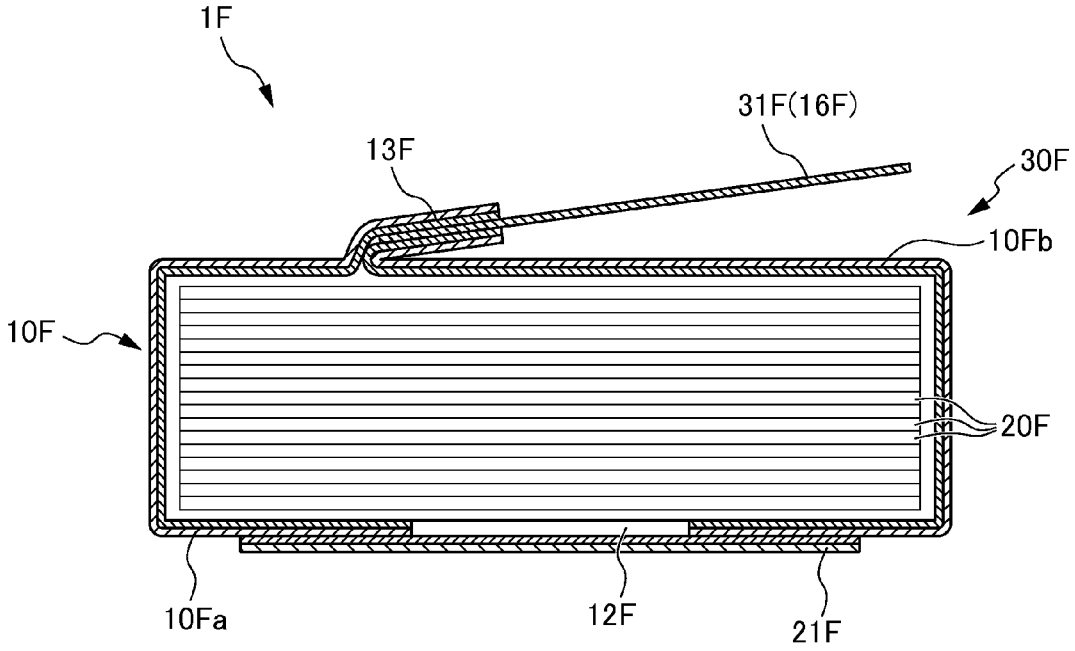
FIG. 17 is a sectional view of a wet tissue package according to a seventh embodiment, corresponding to FIG. 5.

Next, a seventh embodiment of the wet tissue package according to the present invention will now be described with reference to FIG. 17. FIG. 17 is a sectional view of the wet tissue package 1F according to the seventh embodiment. The drawing corresponds to a sectional view at intersecting line C-C of FIG. 1.

The configuration of the joined portion of a seal material 16F and a center seal 13F on the wet tissue package 1F according to the seventh embodiment is different from that of the sixth embodiment. Other portions have the same configuration as that of the sixth embodiment. With the seventh embodiment, the sheet material 16F is joined to the center seal 13F interposed between the two-layered sheet member 11F that composes the center seal 13F.

The wet tissue package 1F pursuant to the seventh embodiment has the effects (1) to (4), and (8) described above.

Preferred embodiments of wet tissue packages according to the present invention and production methods therefor were described above. However, it should be noted that the invention is in no way limited to these embodiments. Appropriate modifications can also be applied.

For example, with the first to the seventh embodiments, the present invention was applied to a rectangular wet tissue package, in a plan view. However, this is not a limitation. That is to say, the present invention can also be applied to a square wet tissue package, when seen in the plan view.

Figure 18:
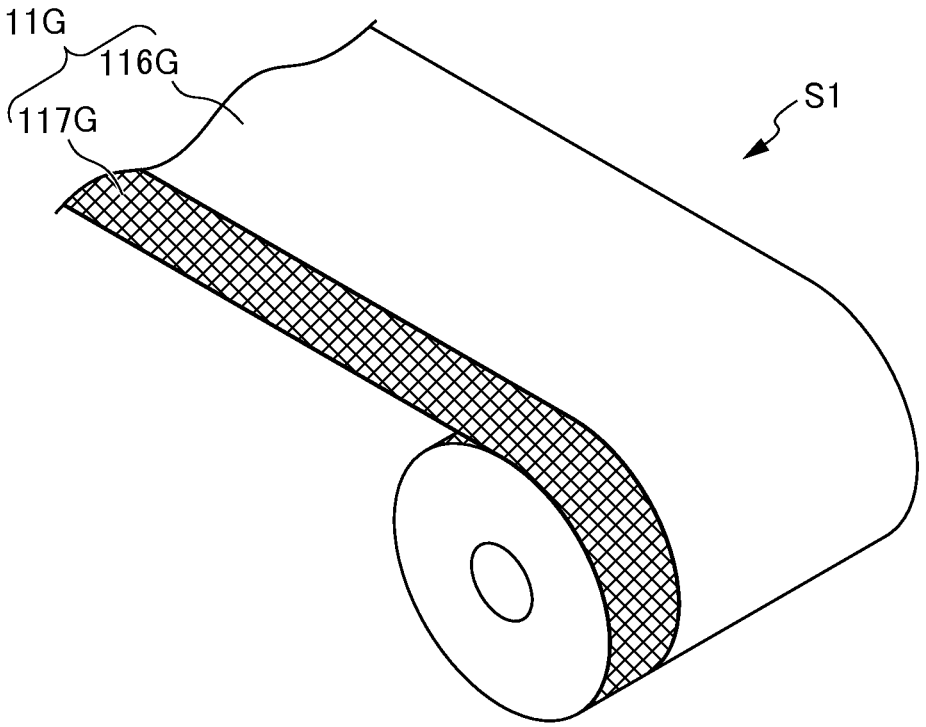
FIG. 18 is a view of a diagram showing a modification to a sheet material that composes the wet tissue package.

Furthermore, with the sixth and the seventh embodiments, the center seal extension 31 is composed of a sheet member 16E that is a different body to the sheet member 11 that composes the package body 10. This sheet member 16E forms the center seal extension 31 by being fed by the second feeding process S51, but the invention is not to be construed to be limited thereto. That is to say, as shown in FIG. 18, it is acceptable to compose the belt-shaped sheet member 11G that is fed at the feeding process S1 by aligning in a width direction a first sheet member 116G that forms the package body, and a second sheet member 117G that composes the center seal extension. With this, the center seal extension can be composed by the second sheet member 117G that has a different material quality to the first sheet member 116G that composes the package body without having to establish the second feeding process.

Furthermore, with the first to the seventh embodiments, the sheet member is composed using a two-layer structure of the barrier layer that is placed at the first sealant layer that composes the inner surface of the package body, and the outer surface side of the first sealant layer, or a three-layer structure that further includes a second sealant layer disposed on the outer surface side of the barrier layer. However, the present invention is not to be construed to be limited to these structures. That is to say that it is also acceptable to dispose another layer at the outer surface side of the barrier layer or the outer surface side of the second sealant layer. Also it is acceptable to implement printing and the like of another layer.

Furthermore, it is acceptable to configure the wet tissue package by equipping it at an inner surface of the leading edge of the center seal extension and the bottom surface of the package body with a locking member (for example, a mechanical fastener) that enables the leading edge of the center seal extension and the bottom surface of the package body to become detached.

The invention claimed is:

1. A wet tissue package equipped with a package body that stores a plurality of wet tissues, and a used wet tissue storage receptacle disposed at an outer surface of the package body, wherein:

the package body, comprises a first seal portion formed by joining a pair of first side edges of a sheet member, a pair of second seal portions formed by joining a pair of joined second side edges that extends in a direction that intersects the pair of first side edges of the sheet member formed with the first seal portion, and a wet tissue housing that houses a plurality of wet tissues; and wherein the used wet tissue storage receptacle is composed of the first seal portion, a first seal extension portion formed by extending in a direction that intersects a direction that the first side edges extend from the first seal portion, and the sheet member that composes the package body, the sheet member has a lamination with a barrier layer and a sealant layer, the barrier layer is composed of a material non-permeable to a gaseous body or liquid, and the sealant layer is composed of thermoplastic resin film, the sealant layer composes an inner surface of the package body and the barrier layer composes an outer surface of the package body, and the barrier layer being composed of a surface opposing the outer surface of the package body, at the first seal extension portion, wherein a pair of side portions along the direction that the first seal extension portion extends are not joined to the pair of second seal portions.

2. The wet tissue package according to claim 1, wherein the package body is composed of a solid shape have a top surface and a bottom surface, wherein the first seal portion is disposed biased to one side in a direction that the second side edges extend, on the bottom surface of the package body.

3. The wet tissue package according to claim 1, wherein the first seal extension portion is configured by extending a sheet member of one of the sheet members joined together that compose the first seal portion.

4. A wet tissue package equipped with a package body that stores a plurality of wet tissues, and a used wet tissue storage receptacle disposed at an outer surface of the package body, wherein:

the package body, comprises a first seal portion formed by joining a pair of first side edges of a sheet member, a pair of second seal portions formed by joining a pair of joined second side edges that extends in a direction that intersects the pair of first side edges of the sheet member formed with the first seal portion, and a wet tissue housing that houses a plurality of wet tissues; wherein the used wet tissue storage receptacle is composed of the first seal portion, a first seal extension portion formed by extending in a direction that intersects a direction that the first side edges extend from the first seal portion, and the seat member that composes the package body, the sheet member has a lamination with a barrier layer and a sealant layer, the barrier layer composed of a material non-permeable to a gaseous body or liquid, and the sealant layer composed of thermoplastic resin film, the sealant layer composes an inner surface of the package body and the barrier layer composes an outer surface of the package body, the barrier layer being composed of a surface opposing the outer surface of the package body, at the first seal extension portion, and wherein the first seal portion which is a base end of the first seal extension portion, has the sheet members mutually overlapped, that the sealant layers are sandwiched in between the barrier layers and joined each other.

5. The wet tissue package according to claim 4, wherein the first seal extension portion is composed of a sheet material extending from the first seal portion, the sheet material is different from the sheet member.

* * * * *